US005384626A

United States Patent [19]

Kugoh et al.

[11] Patent Number: 5,384,626

[45] Date of Patent: Jan. 24, 1995

[54] CHARGING MEMBER, PROCESS CARTRIDGE AND IMAGE FORMING APPARATUS

[75] Inventors: Harumi Kugoh, Kawasaki; Junji Araya, Yokohama; Hideyuki Yano, Yokohama; Tadashi Furuya, Yokohama, all of Japan

[73] Assignee: Canon Kabushiki Kaisha, Tokyo, Japan

[21] Appl. No.: 116,704

[22] Filed: Sep. 7, 1993

[30] Foreign Application Priority Data

Sep. 7, 1992 [JP] Japan ..... 4-264293

[51] Int. Cl.[6] ..... G03G 15/02

[52] U.S. Cl. ..... 355/219; 355/210; 361/225

[58] Field of Search ..... 355/219, 200, 210, 231; 361/225, 229

[56] References Cited

U.S. PATENT DOCUMENTS

| | | | |
|---|---|---|---|
| 3,936,170 | 2/1976 | Shibano et al. | 355/271 |
| 4,309,803 | 1/1982 | Blaszak | 355/219 X |
| 4,727,453 | 2/1988 | Ewing | 361/225 |
| 5,243,387 | 9/1993 | Ikegawa | 355/219 |

FOREIGN PATENT DOCUMENTS

| | | |
|---|---|---|
| 0323252 | 7/1989 | European Pat. Off. . |
| 0400563 | 12/1990 | European Pat. Off. . |
| 63-149669 | 6/1988 | Japan . |
| 63-167380 | 7/1988 | Japan . |
| 4051266 | 2/1992 | Japan . |

*Primary Examiner*—Joan H. Pendegrass

*Attorney, Agent, or Firm*—Fitzpatrick, Cella, Harper & Scinto

[57] ABSTRACT

A charging member for charging a member to be charged while being in contact therewith includes conductive base for being supplied with a voltage; a surface layer contactable to the member to be charged; a sponge layer between the conductive base and the surface layer; a 100% modulus $M_{100}$ (kg/cm$^2$) of the surface layer and a thickness d (cm) of the surface layer satisfied:

$$M_{100} \times d \leqq 1.5 \text{ (kg/cm)}.$$

9 Claims, 5 Drawing Sheets

CHARGING MEMBER, PROCESS CARTRIDGE AND IMAGE FORMING APPARATUS

FIELD OF THE INVENTION AND RELATED ART

The present invention relates to a charging member, a process cartridge and image forming apparatus using the same in which a member to be charged is electrically charged or discharged by the charging member contacted to the member to be charged and supplied externally with a voltage.

In an image forming apparatus using an image formation process such as an electrophotographic or electrostatic recording process including charging an image bearing member (a member to be charged) such as an electrophotographic photosensitive member or electrostatic recording dielectric member or the like (examples of such image forming apparatus include an electrophotographic copying machine, printer or electrostatic recording apparatus), a contact type charging device such as disclosed in Japanese Laid-Open Patent Application No. 167380/1988 is used to charge the image bearing member, in which a charging member (conductive member or contact electrode) is contacted to the image bearing member and is supplied with a voltage.

The contact type charging device is advantageous as compared with conventional non-contact type corona chargers, in the usability of a low applied voltage and in small ozone production.

FIG. 2 is a schematic view of an example of the contact type charging device. Designated by a reference numeral 1 is a rotatable photosensitive drum functioning as the image bearing member in the electrophotographic copying machine or printer.

The photosensitive drum comprises a conductive drum base 10 of aluminum or the like and a photosensitive layer 11 thereon of an organic photoconductor (OPC), amorphous silicon, selenium, zinc oxide or another photoconductive semiconductor material. It is rotated with a predetermined peripheral speed in a direction indicated by an arrow.

Designated by a reference numeral 2 is a charging member in the form of a charging roller contacted to the surface of the photosensitive drum 1 which is a member to be charged. The charging roller 2 comprises:

a. A core metal **2*d*** in the form of a roller functioning as a conductive base (electrode);

b. A low resistance elastic resistance layer **2*b*** (first resistance layer) which is formed outside and coaxially with the core metal, which is made of rubber containing conductive fine particles such as carbon or the like, and which has a volume resistivity of $10^3$ ohm.cm approximately, for example;

c. A surface resistance layer **2*c* (second resistance layer) which covers the outside of the elastic resistance layer 2*b***, which is made of resin material or the like containing conductive fine particles such as tin oxide ($SnO_2$), which has a volume resistivity of approximately $10^6$–$10^{10}$ ohm.cm and which has a thickness of several tens and several hundreds microns.

It extends in parallel with the photosensitive drum 1, and is supported by bearings at the opposite ends of the core metal. It is urged with a predetermined pressure to the photosensitive drum 1 surface by urging means. In this example, it is rotated by the photosensitive drum 1 in a direction indicated by an arrow b.

Designated by a reference numeral 3 is a voltage source for applying a voltage to the core metal 20 (conductive base). The core metal 20 of the charging roller 2 is supplied from the voltage source 3 with a predetermined DC voltage or oscillating voltage, so that the surface of the rotating photosensitive drum 1 is electrically charged to a predetermined polarity and to a predetermined potential by the charging roller 2.

Around the photosensitive drum 1, there are provided in addition to the charging device, image information exposure means, toner developing means, toner image transfer means, cleaning means for cleaning the photosensitive drum, or another image forming process means, thus constituting an image forming apparatus. However, they are omitted for the sake of simplicity.

The contact type charging mechanism is considered as follows. Dielectric break-down of air occurs in a small gap adjacent to a contact portion between the charging member 2 and the member to be charged 1, by which the electric charge moves from the charging member 2 to the member to be charged 1 (charging current flow) is caused.

The voltage applied to the charging member 2 may be a DC voltage only (DC application type) or an oscillating voltage (AC application type) which is an alternating voltage or pulsewise voltage or the like having a voltage level which periodically changes with time.

The AC application type is advantageous over the DC application type in that it has a larger latitude from the standpoint of the uniform charging. As disclosed in Japanese Laid-Open Patent Application No. 149669/1988 which has been assigned to the assignee of this application, the applied voltage may be a DC voltage biased with an AC voltage which has a peak-to-peak voltage which is larger than twice the charge starting voltage of the member to be charged when only a DC voltage is applied to the charging member. This is advantageous because microscopic charge defects tending to occur in the case of DC application type (fine overcharged areas) can be prevented, thus permitting uniform charging of the member to be charged.

In the contact charging, the charging member 2 contacted to the member to be charged may be a rigid conductive base such as metal or the like, but the direct contact between the hard charging member and the member to be charged 1 involves the following difficulties:

1. It is difficult to maintain the uniform contact therebetween and therefore the uniform charging is difficult;
2. The member to be charged may be easily damaged or worn by the hard charging member; and
3. Foreign matter entered into between the charging member and the member to be charged, may be strongly urged to the surface of the member to be charged by the hard charging member with the result of secured deposition thereof on the surface to be charged.

In the case of an image forming apparatus, the foreign matter may be toner particles which can be rubbed on the image bearing member with strong pressure with the result of toner fusing on the image bearing member.

The toner fusing may occur for the following reason. The toner particles having passed by the cleaning means are strongly pressed on the surface of the image bearing member by a member contacted to the image bearing member such as a contact charging member, by which the heat resulting from the friction fuses the toner.

The toner fused on the image bearing member does not pass the light, and therefore, even if the portion is exposed to the light, the surface potential of the portion of the image bearing member does not become lower, with the result of non-image (white dot) as shown in FIG. 5 in a reverse development system.

Therefore, a low hardness of the charging member is preferable. For example, the known materials of the elastic resistance layer *2b* in FIG. 2 include electroconductive rubber material such as conductive EPDM or electroconductive elastic foamed material. By the properly adjusted elasticity of the elastic resistance layer *2b*, the hardness of the charging member 2 is lowered, so that uniform contact is assured between the charging member 2 and the member to be charged, and in addition, in the case of an image forming apparatus, the pressure between the charging member 2 and the image bearing member surface is eased, thus easing the toner fusing. Because of the low resistance of the elastic resistance layer *2b*, the voltage applied to the conductive base *2a* is not greatly attenuated, and a sufficient voltage is applied between the member to be charged and the surface layer of the charging member.

However, even if such a low hardness contact type charging member is used as a charging means for the image bearing member of an image forming apparatus, the toner fusing on the image bearing member occurs particularly under high temperature and low humidity conditions.

SUMMARY OF THE INVENTION

Accordingly, it is a principal object of the present invention to provide a charging member, a process cartridge and an image forming apparatus in which the toner fusing on an image bearing member is effectively prevented.

It is another object of the present invention to provide a charging member, a process cartridge and an image forming apparatus in which the charging member is softly contacted to the member to be charged.

It is a further object of the present invention to provide a charging member, a process cartridge and an image forming apparatus by which satisfactory images can be formed irrespective of image forming conditions.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 7:
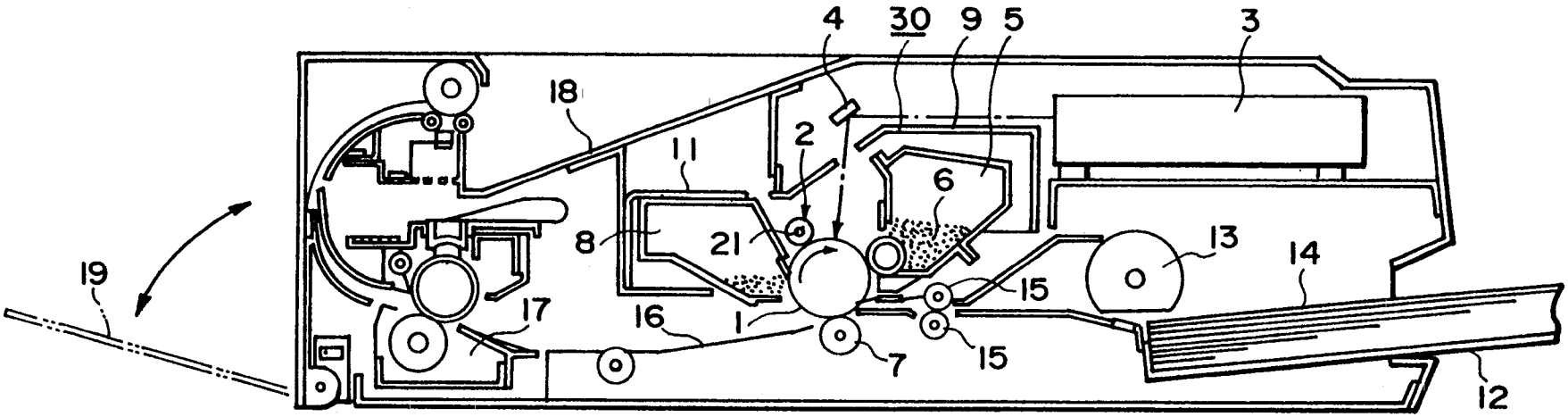
FIG. 7 is a sectional view of an image forming apparatus according to an embodiment of the present invention.

Referring to FIG. 7, there is shown an image forming apparatus according to an embodiment of the present invention. In this embodiment, the image forming apparatus is a laser beam printer of a detachable process cartridge type using an image transfer type electrophotographic process.

In this Figure, the image forming apparatus comprises a rotatable drum type electrophotographic photosensitive member (photosensitive drum) 1. The photosensitive drum 1 is rotated at a predetermined peripheral speed (process speed) in the indicated clockwise direction through a drive transmission mechanism by a driving source.

A charging member 2 is press-contacted with a predetermined pressure onto the photosensitive drum 1. The charging member of this embodiment is in the form of a roller. The charging roller 2 has an outside diameter of 12 mm. The opposite end portions of the electroconductive core metal 21 of the charging roller are pressed to the surface of the photosensitive member by unshown springs, so that it is rotated by the photosensitive drum 1 rotation. By application of a predetermined voltage from a voltage source to the conductive core metal 29, the peripheral surface of the rotatable photosensitive drum 1 is uniformly charged to the predetermined polarity and to the predetermined potential through a contact charging process by the charging roller 2.

The charged surface of the photosensitive drum 1 is scanned by and exposed to a laser beam from a laser scanner unit, the laser beam having been modulated in accordance with time series digital pixel signals corresponding to the intended image information. By this, an electrostatic latent image corresponding to the image information is formed on the peripheral surface of the rotating photosensitive drum 1.

The electrostatic latent image is visualized through a reverse developing system with the toner in the developing device 5 into a toner image. The toner image is sequentially transferred onto the surface of the transfer material 14 supplied to between the photosensitive drum 1 and the transfer roller 7 at the transfer roller 7 position. The transfer roller 7 is supplied with a transfer bias of the polarity opposite from that of the toner, from an unshown voltage source. By the application of an opposite polarity charge to the backside of the transfer material, the toner image is transferred from the photosensitive drum 1 onto the transfer material.

Designated by reference numeral 12 is a sheet feeding cassette detachably mountable relative to the main assembly of the image forming apparatus. The transfer material 14 in the cassette is separated and fed out one-by-one by sheet feeding roller 13 rotated in response to sheet feed signal and a separation pad (not shown) faced to the roller 13. It is then fed to a pair of registration rollers 15 along the upper and lower guides. The registration roller 15 is at rest until the transfer material comes thereto. By abutment of a leading edge of a transfer material 14 to the registration roller, the inclined movement of the transfer material 14 is corrected. Then the registration rollers 15 feed the transfer material 14 to the transfer position between the photosensitive drum 3 and the transfer roller 7 so that it is aligned with the leading edge of the image formed on the photosensitive drum 1. The transfer material, having been subjected to the toner image transfer at the transfer position, is separated from the photosensitive member surface and is fed to an image fixing device 17 by a feeding roller and a feeding guide 16. The fixing device 17 fuses and fixes the toner image on the transfer material 14 by heat and pressure into a recorded image. The transfer material 14, after the image fixing, is discharged to a discharge tray 18 or 19 through a sheet feed passage selected by a flapper (not shown).

The rotating photosensitive drum 1 after the toner image transfer is cleaned by a cleaner 8 so that the foreign matter thereon such as residual toner or the like is removed, and is prepared for the next image forming operation.

The printer of this embodiment is usable with a process cartridge 30 which is as a whole detachably mountable to the main assembly of the printer, the process cartridge contains four process means, namely, the photosensitive drum 1, the charging roller 2, the developing device 5 and the cleaner 8, in a cartridge casing 9.

In mounting and demounting the process cartridge, the process cartridge 30 is engaged with a guide 11 (FIG. 7) of the main assembly of the printer, and it is pushed in or pulled out along the guide 11. When the process cartridge 30 is sufficiently inserted into the printer main assembly, it is mechanically and electrically connected with the printer main assembly.

The process cartridge of this invention may contain at least the photosensitive drum 1 and the charging member in the form of a charging roller 2.

The inventors' experiments and investigations have revealed that 100% modulus $M_{100}$ (kg/cm$^2$) of the surface layer of the charging member contacted to the member to be charged and a thickness d (cm) of the surface layer preferably satisfy $M_{100} \times d \leqq 1.5$. By doing so, as will be shown in the results of experiments, the foreign matter entered between the charging member and the member to be charged is effectively prevented from being strongly adhered to the surface of the member to be charged, more particularly, in the case of the image forming apparatus, the toner fusing on the image bearing member surface can be effectively prevented, even under the conditions of high temperature and high humidity and in the long term operation of the apparatus.

The 100% modulus is defined by JIS, and is the force per unit area required to expand a material having a length L by a length L, that is, the force required to expand the length by 100%. It represents the ease or difficulty of expansion of the material.

Figure 6A:
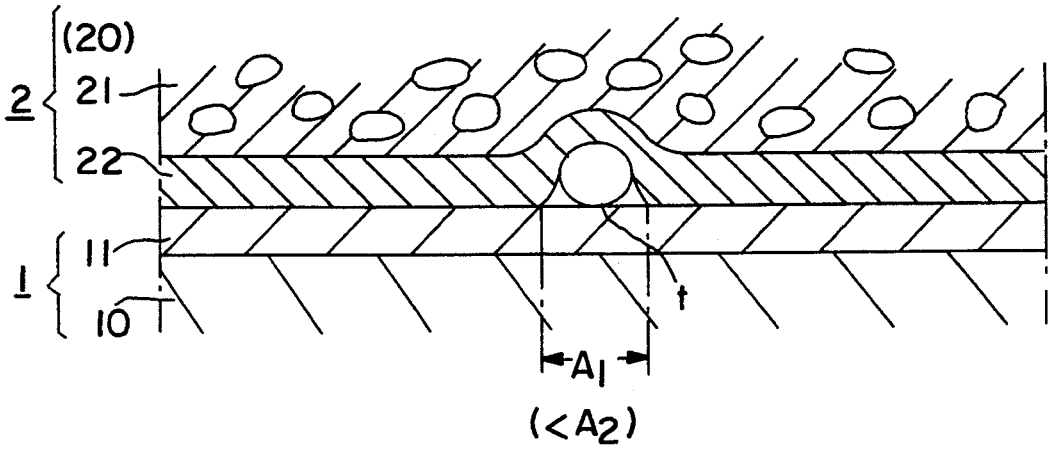
FIGS. 6A and 6B are enlarged sectional view of charging members.
Figure 6B:
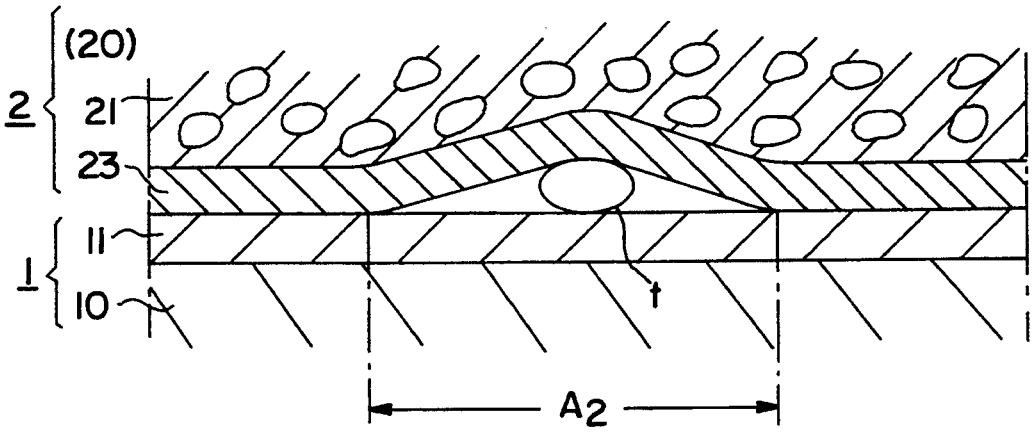

FIG. 6 (FIGS. 6A and 6B) is a schematic illustration in which the foreign matter (toner) t is between the charging member 2 and the member to be charged 1. Even if the overall hardness of the charging member 2 is lowered by lowering the elasticity of the elastic resistance layer 21, the problem arises if the extensibility of the surface resistance layer 23 is small. More particularly, a relatively wide marginal portion A2 around the entered foreign matter t on the surface resistance layer 23 is raised against the elasticity of the elastic layer 21 to become out of contact with the surface of the member to be charged, with the result that the foreign matter t receives almost all of the contact pressure imparted by the charging member 2, and therefore, the foreign matter t is pressed to the surface of the member to be charged with relatively strong pressure. In the case of the image forming apparatus, the possibility of the toner fusing occurs is still high during the operation thereof. This is particularly probable under high temperature and high humidity conditions. When the surface resistance layer 22 has the 100% modulus which satisfies $M_{100} \times t$ is not less than 1.5, the marginal area A1 around the foreign matter t where the surface resistance layer 22 is out of contact with the surface of the member to be charged 1, is relatively small. Therefore, the foreign matter t is pressed to the surface of the member to be charged 1 with only a small pressure smaller than the contact pressure provided by the charging member 2.

Since the surface resistance layer 22 contacted to the member to be charged 1 has a larger extensibility, and therefore, the urging pressure by the charging member 2 to press the foreign matter t to the member to be charged 1 is reduced. In an image forming apparatus, the toner fusing on the image bearing surface 1 during operation thereof, can be effectively prevented.

Surface resistance layers 22 having the same moduluses exhibit different extensibilities, that is, if the layer thickness is smaller, the extensibility is larger. Therefore, simple reduction of the layer thickness of the surface resistance layer 22 could result in the increase of the extensibility of the surface resistance layer and therefore reduction of the pressing force applied to the foreign matter t by the charging member 2. Therefore, the occurrence of the toner fusing on the image forming apparatus can be eased. However, if the thickness of the surface resistance layer 22 is too small, the desired functions of the surface resistance layer may be deteriorated. The functions include an oil barrier function, a charge current leakage preventing function in case where the member to be charged has pin hole defects or low voltage durability defects, a function of preventing resistance distribution non-uniformity from resulting in charge non-uniformity when the elastic resistance layer 21 is of foamed material (sponge of the like). Therefore, the surface resistance layer 22 preferably has a thickness not less than 50 microns to assure these functions.

EMBODIMENT 1

Figure 1:
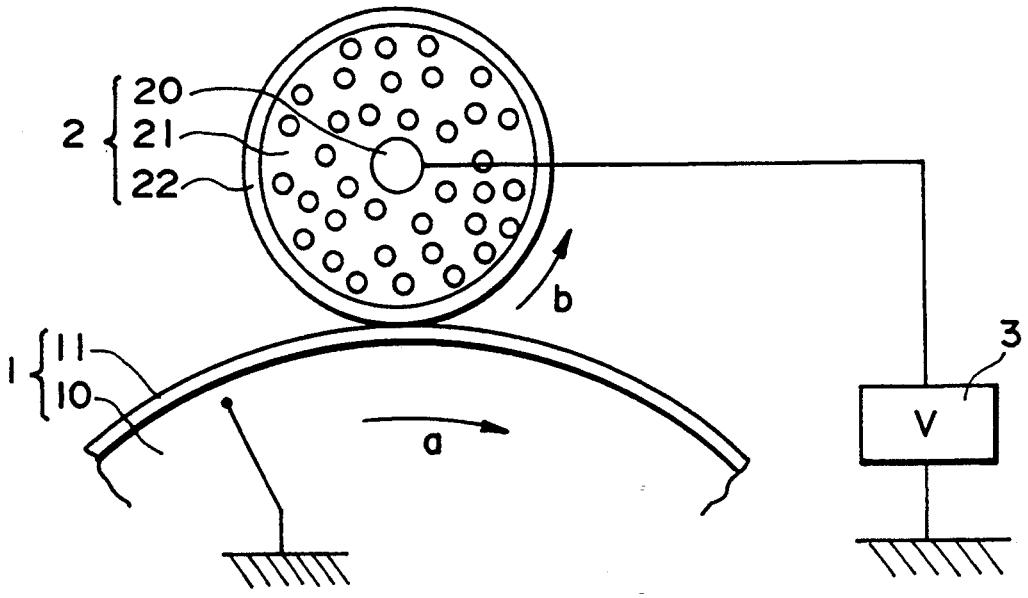
FIG. 1 is a sectional view of an example of a contact type charging device.
Figure 2:
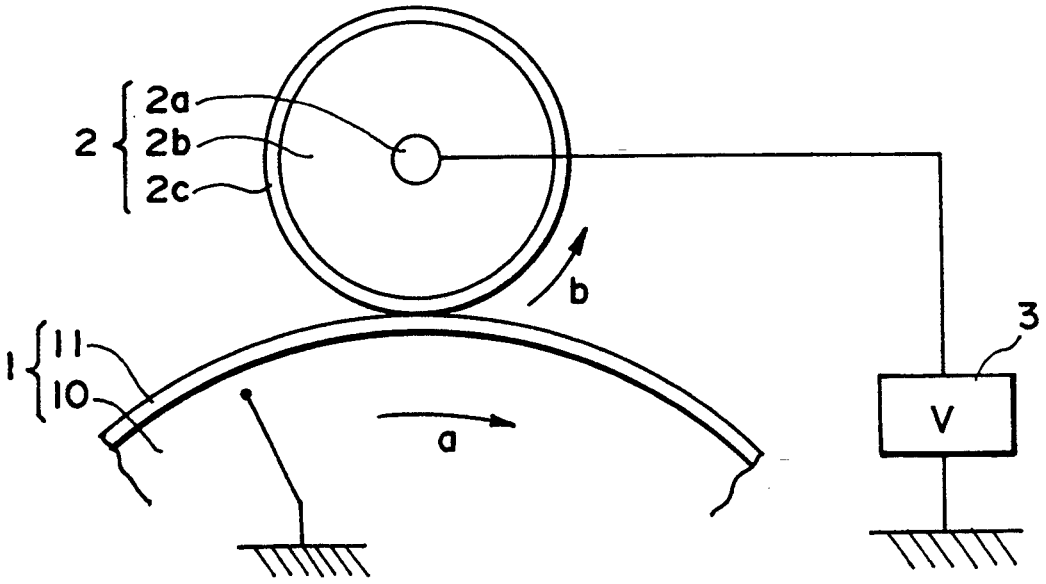
FIG. 2 is a sectional view of a contact type charging device in the prior art.

A charging roller comprising a surface resistance layer 22, an elastic resistance layer 21 of foamed material, and a core metal roller 20 (conductive base), as shown in FIG. 1, has been produced with the following specifications:

a. Core metal roller 20: metal rod having a diameter of 6 mm
b. Elastic resistance layer 21: EPDM foamed material having a volume resistance of $10^6$ ohm.cm by dispersing carbon:
Thickness: 3 mm Surface resistance layer 22: provided by applying resin material having a volume resistivity of $10^6$–$10^{10}$ ohm.cm by dispersing fine particles of tin oxide.

The material of the major component, 100% modulus $M_{100}$ and the layer thickness d of the surface resistance layer 22 have been changed as shown in Table 1 (samples 1–8).

Among the component of the resin material of Table 1, Toresin is a trade name (Teikoku Kagaku Kabushiki Kaisha, Japan) of N methoxy nylon. In this material, metal oxide such as $TiO_2$ is dispersed.

The charging rollers of the samples 1–8, are incorporated in an electrophotographic copying machine or printer as a primary charger for the photosensitive drum, and the image forming operations are carried out under the following conditions:

Photosensitive drum: OPC photosensitive material

Process speed (peripheral speed of the photosensitive drum): 94 mm/sec

Voltage applied to the charging roller: DC+AC (DC component of 700 V and the AC component having a peak-to-peak to-peak voltage of 2000 V and a frequency of 550 Hz).

Under a high temperature and high humidity conditions (32.5° C. and 85%), 8000 A4 size sheets are processed at a rate of 16 sheets per minute. After that, the evaluation has been made with respect to the degree of toner fusing, the image quality deterioration due to pin holes or the like of the photosensitive drum (the image non-uniformity attributable to the leakage of the charging current relative to the pin holes).

The evaluations are also given in Table 1, wherein "G" means Good, and "N" is No good. As will be understood from this Table, the toner fusing can be effectively prevented if the surface resistance layer 22 satisfies that $M_{100}$ xd (kg/cm) is not more than 1.5.

Even if $M_{100}$ xd is reduced by reducing the thickness d of the surface resistance layer 22, the image non-uniformity due to the pin hole occurs as in sample 7 in Table 1. Therefore, the thickness d is preferably not less than 50 microns. The usable materials of the elastic resistance layer 21 include in addition to EPDM, silicone rubber, IR, foamed material such as urethane rubber.

The material of the surface resistance layer 22 is not limited to the foregoing acrylic resin, Toresin or urethane if $M_{100}$xd $\leqq 1.5$, and if it has the properties required as the charging member.

In this embodiment, the resistance layer 21 is of a foamed material, by which the hardness of the charging roller can be reduced the so-called charging noise arising in the case of AC application type can be suppressed.

TABLE 1

| | Surface resistance layer 22 | | | | Evaluation | |
|---|---|---|---|---|---|---|
| Samples | Main components | $M_{100}$ (kg/cm$^2$) | d (cm) | $M_{100}$xd | Fusing adhesion | Image |
| 1 | Acrylic resin | 8 | $2.0 \times 10^{-2}$ (200 μm) | 0.16 | G | G |
| 2 | Toresin | 107 | $1.2 \times 10^{-2}$ (120 μm) | 1.3 | G | G |
| 3 | Urethane A | 18 | $8.0 \times 10^{-3}$ (80 μm) | 0.14 | G | G |
| 4 | Urethane B | 139 | $8.0 \times 10^{-3}$ (80 μm) | 1.1 | G | G |
| 5 | Urethane B | 139 | $1.6 \times 10^{-2}$ (160 μm) | 2.2 | N | G |
| 6 | Urethane C | 220 | $9.0 \times 10^{-3}$ (90 μm) | 2.0 | N | G |
| 7 | Urethane D | 301 | $4.5 \times 10^{-3}$ (45 μm) | 1.4 | G | N |
| 8 | Urethane D | 301 | $8.0 \times 10^{-3}$ (80 μm) | 2.4 | N | G |

The modulus changes depending on conductive material such as metal oxide contained in the surface layer for the purpose of adjusting the resistance of the surface layer.

The image bearing member 1 (the member to be charged) is not limited to the drum type, but may be a belt type or sheet type or the like.

The charging roller 2 may be a non-rotatable roller, or positively driven roller. The charging member 2 is not limited to the roller type but may be abrade type, pad type, block type, rod type, belt type, sheet type, brush type or the like.

Figure 3:
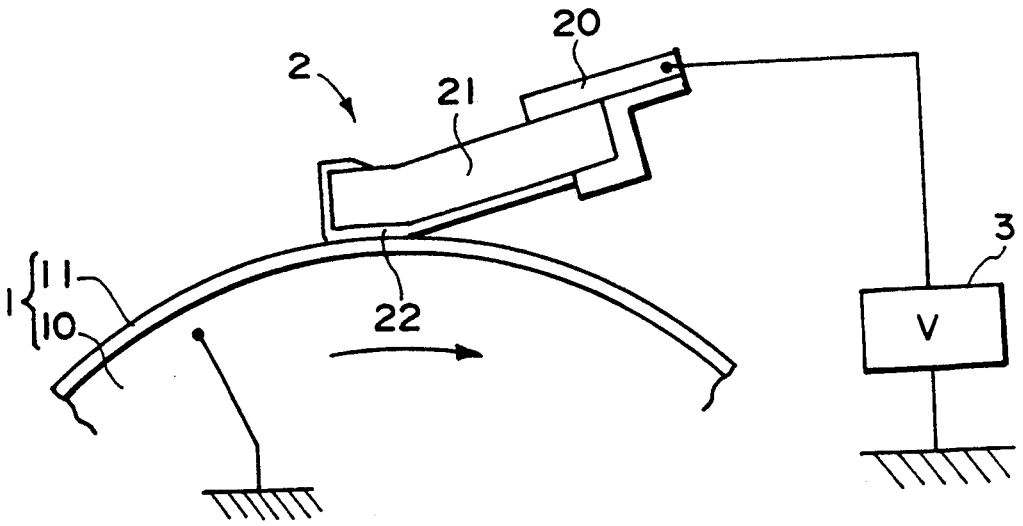
FIG. 3 is a sectional view of an example of a charging blade.
Figure 4:
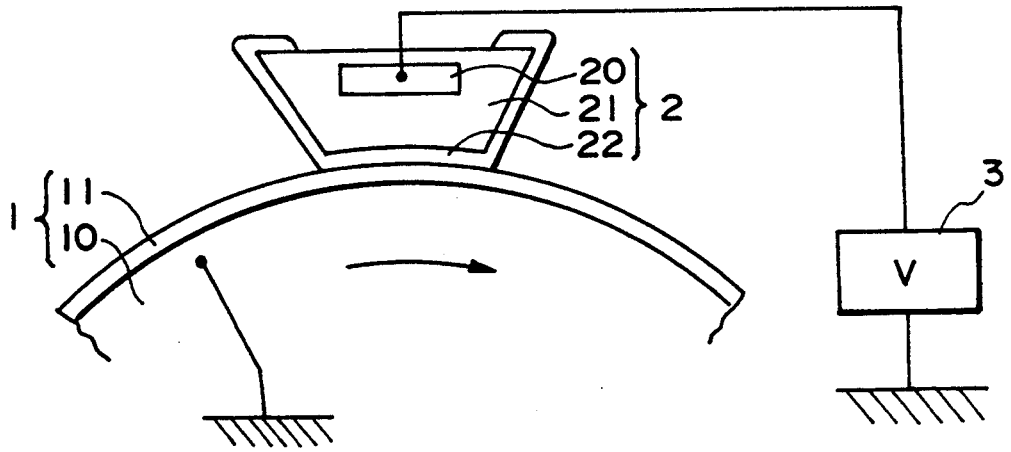
FIG. 4 is a sectional view of an example of a block or pad shaped charging member.
Figure 5:
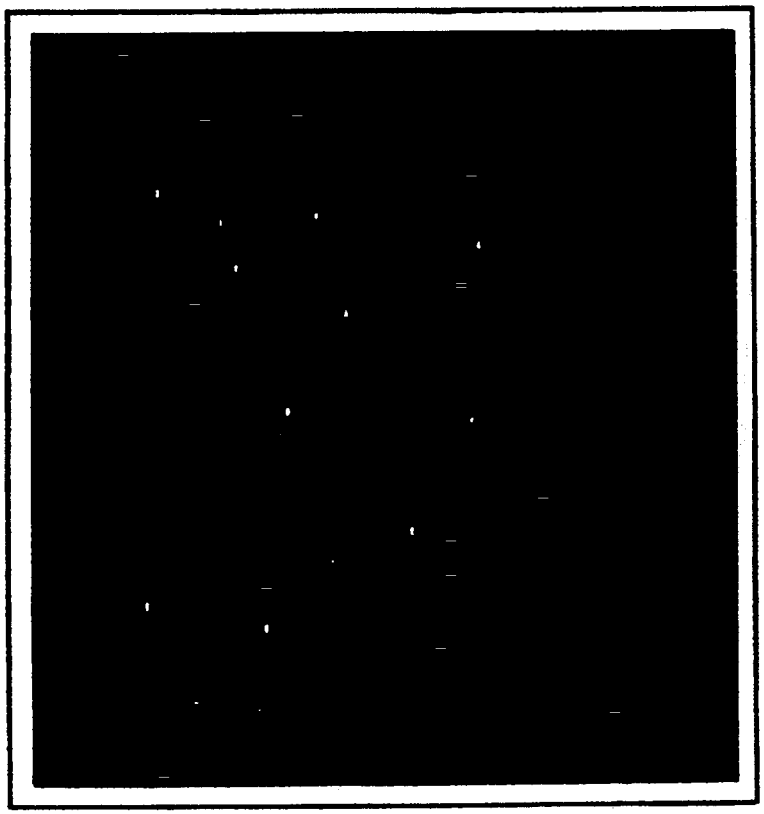
FIG. 5 illustrates a reverse-developed image in which non-image portions (white dots) occurred by the fused toner on the image bearing member.

In FIG. 3, the charging member is in the form of a blade in place of roller, and in FIG. 4, it is in the form of a block or pad.

The wave form of an oscillating voltage (alternating voltage) applied to the charging member may be a sine wave, a rectangular wave, a triangular wave, a pulse wave of the like. The pulse wave voltage may be provided by periodically actuating and deacting a DC voltage. In order to prevent occurrence of spot like non-uniformity of the charging, the peak-to-peak voltage of the oscillating voltage is preferably not less than twice as large as the charge starting voltage of the member to be charged.

The surface resistance layer 22 has a function of preventing oil from seeping from the elastic resistance layer 21 to the outside of the charging member, and the function of adjusting the resistance of the charging member 2. Therefore, it preferably comprises as a major component non-rubber resin material.

The elastic layer 21 comprises quite a large amount of conductive particles in a rubber material for the purpose of reducing the resistance. However, a large amount of conductive particles leads to increasing the hardness of the rubber material, and correspondingly, a large amount of oil is contained to reduce the hardness.

The oil tends to seep out from the elastic layer 21 to the outside. If the elastic resistance layer 21 is directly contacted to the member to be charged 1, the seeped oil is deposited on the surface of the member to be charged, thus contaminating it. If the member to be charged is an image bearing member of an image forming apparatus, the image bearing member is deteriorated, and the image quality is reduced. The surface resistance layer 22 prevents the oil from seeping from the elastic layer 21 to the outside surface of the charging member.

When the low resistance elastic layer 21 is directly contacted to the member to be charged 1, the charging current concentratedly flows to a the low voltage durability portion such as a pin hole or the like on the surface to be charged with the result of occurrence of non-charged spot or spots.

The surface resistance layer 22 preferable has a volume resistivity larger than that of the elastic resistance layer 21, by which the required charging current is permitted to flow uniformly, and a concentrated leakage to the pin hole or the like is reduced by the resistance even when the charging member 2 is contacted to the pin hole portion of the member to be charged.

While the invention has been described with reference to the structures disclosed herein, it is not confined to the details set forth and this application is intended to cover such modifications or changes as may come within the purposes of the improvements or the scope of the following claims.

What is claimed is:

1. A charging member for charging a member to be charged while being in contact therewith, comprising:
   - a conductive base for being supplied with a voltage;
   - a surface layer contactable to the member to be charged;
   - a sponge layer between said conductive base and said surface layer;
   - a 100% modulus $M_{100}$ (kg/cm$^2$) of said surface layer and a thickness d (cm) of the surface layer satisfied:

$$M_{100} \times d \leqq 1.5 (\text{kg/cm}).$$

2. A process cartridge detachably mountable to an image forming apparatus, comprising:
   - an image bearing member;
   - a charging member contactable to said image bearing member to electrically charge said image bearing member, said charging member including a conductive base for being supplied with a voltage, a surface layer contactable to said image bearing member and a sponge layer between said conductive base and said surface layer;
   - wherein a 100% modulus $M_{100}$ (kg/cm$^2$) of said surface layer and a thickness d (cm) of the surface layer satisfy:

$$M_{100} \times d \leqq 1.5 (\text{kg/cm}).$$

3. A process cartridge according to claim 2, wherein said process cartridge contains developing means for developing said image bearing member with toner.

4. An image forming apparatus comprising:
   - an image bearing member;
   - a charging member contactable to said image bearing member to electrically charge said image bearing member, said charging member including a conductive base for being supplied with a voltage, a surface layer contactable to said image bearing member and a sponge layer between said conductive base and said surface layer;
   - wherein a 100% modulus $M_{100}$ (kg/cm$^2$) of said surface layer and a thickness d (cm) of the surface layer satisfy:

$$M_{100} \times d \leqq 1.5 (\text{kg/cm}).$$

5. An apparatus according to claim 4, wherein said voltage is an oscillating voltage.

6. An apparatus according to claim 5, wherein said oscillating voltage is an AC voltage biased with a DC voltage.

7. An apparatus according to claim 4, wherein said surface layer has a volume resistivity larger than that of said sponge layer.

8. An apparatus according to claim 4, wherein said surface layer comprises as a major component non-rubber resin material.

9. An apparatus according to claim 4, wherein the thickness of said surface layer is not less than 50 microns.

* * * * *

UNITED STATES PATENT AND TRADEMARK OFFICE

CERTIFICATE OF CORRECTION

PATENT NO. : 5,384,626

DATED : January 24, 1995

INVENTOR(S) : Harumi Kugoh, et al.

It is certified that error appears in the above-indentified patent and that said Letters Patent is hereby corrected as shown below:

TITLE PAGE:

[56] REFERENCES CITED:

FOREIGN PATENT DOCUMENTS

"4051266 2/1992 Japanese" should read
--4-051266 2/1992 Japanese--.

[57] ABSTRACT:

Line 8, "satisfied:" should read --satisfy:--.

COLUMN 3:

Line 67, "view" should read --views--.

COLUMN 4:

Line 47, "to" should be deleted.

COLUMN 8:

Line 64, "preferable" should read --preferably--.

COLUMN 9:

Line 19, "satisfied:" should read --satisfy:--.

Signed and Sealed this

Ninth Day of May, 1995

Bruce Lehman

*Attest:*

BRUCE LEHMAN

*Attesting Officer*

*Commissioner of Patents and Trademarks*